United States Patent [19]

Price

[11] 4,243,219

[45] Jan. 6, 1981

[54] PORTABLE LEAN-TO EXERCISING DEVICE

[76] Inventor: Paul J. Price, 1420 Junior Dr., Pittsburgh, Pa. 15227

[21] Appl. No.: 932,771

[22] Filed: Aug. 11, 1978

[51] Int. Cl.[3] ..... A63B 21/06

[52] U.S. Cl. ..... 272/117; 273/26 B; 273/29 R; 272/119; 272/900

[58] Field of Search ..... 272/118, 117, 124, 142, 272/130, 143, DIG. 4, 900; 273/26 D, 26 B, 29 A, 63 R, 67 A; 187/10

[56] References Cited

U.S. PATENT DOCUMENTS

| | | | |
|---|---|---|---|
| 1,041,020 | 10/1912 | Carstens | 187/10 |
| 2,134,451 | 10/1938 | Mogren | 272/117 |
| 2,588,959 | 3/1952 | Campbell | 187/10 |
| 3,647,209 | 5/1972 | La Lanne | 272/118 |
| 3,746,337 | 7/1973 | Riecke et al. | 272/118 |
| 3,891,062 | 6/1975 | Geneste | 187/10 |
| 3,966,203 | 6/1976 | Bickford | 272/118 |

FOREIGN PATENT DOCUMENTS

| | | | |
|---|---|---|---|
| 16860 | of 1909 | United Kingdom | 187/10 |

*Primary Examiner*—Richard C. Pinkham
*Assistant Examiner*—William R. Browne
*Attorney, Agent, or Firm*—William J. Ruano

[57] ABSTRACT

A portable exercising device comprising a weight frame that may be leaned against the top of a door frame for support, which weight frame supports a weight sled or carriage carrying a selective number of weights. The carriage travels along the weight frame and can be pulled from selective heights, depending upon the position of the pulley on the frame about which a line, which is attached to the carriage, is reeved.

6 Claims, 4 Drawing Figures

PORTABLE LEAN-TO EXERCISING DEVICE

This invention relates to an exercising device and, more particularly, to a device for allowing the use of selective sports items to be swung or otherwise moved so as to develop muscles for the proficient use or handling of such items.

An outstanding disadvantage of commonly used exercising devices is that they are cumbersome in construction, heavy in weight, and require attachment to a wall for resisting loads involved during exercising, —also they are relatively expensive to manufacture.

An object of my invention is to provide a novel exercising device that overcomes the abovenamed disadvantages.

A more specific object of my invention is to provide a readily portable exercising device that requires no attachment to a wall or floor and which involves a minimum number of light weight, standard parts that can be manufactured at very low cost, compared to that of comparable exercising equipment presently used, and that can be compacted into a small package which is readily portable.

Another object of my invention is to provide an exercising device that can be supported on a doorway or the like, such as on a joist in a basement, with no requirement of fastening to either the floor or wall.

Other objects and advantages will become more apparent from a study of the following description taken with the accompanying drawing wherein.

Figure 1:
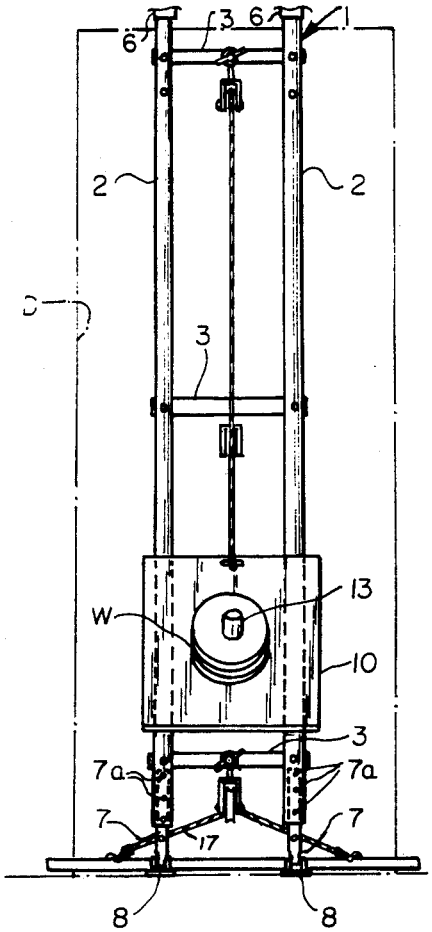
FIG. 1 is an elevational view of an exercising device embodying the principles of the present invention.
Figure 2:
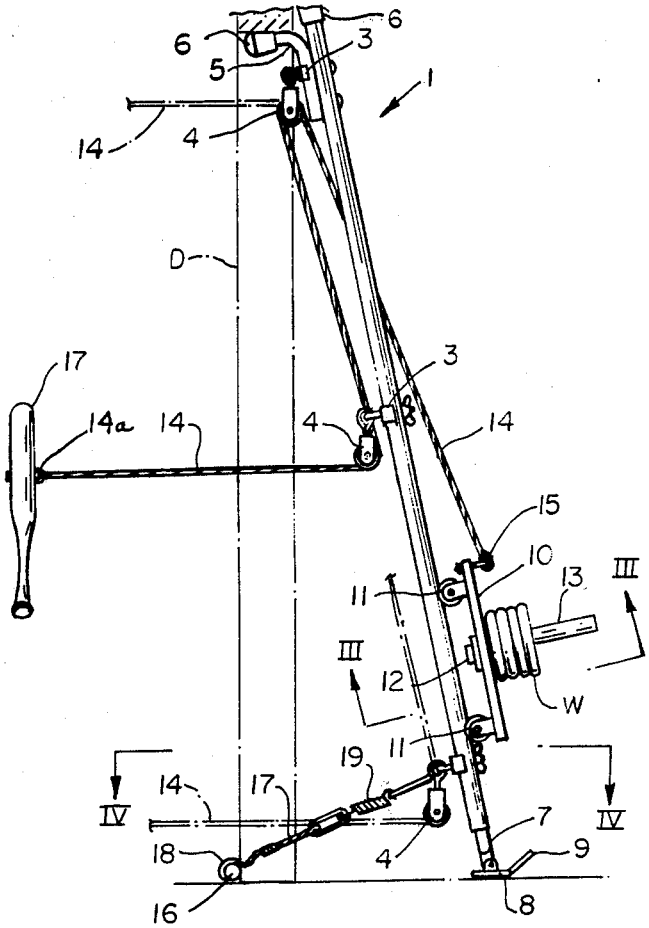
FIG. 2 is a side view of the device shown in FIG. 1.
Figure 3:
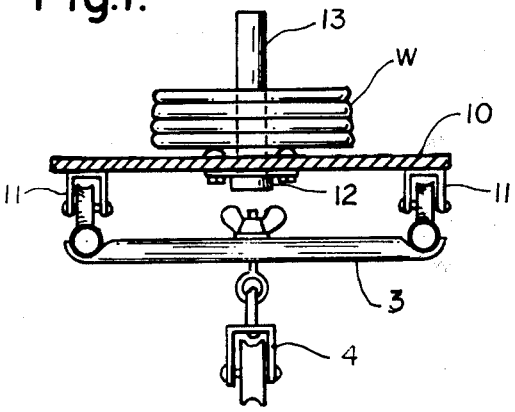
FIG. 3 is an enlarged, cross-sectional view taken along line III—III of FIG. 2.
Figure 4:
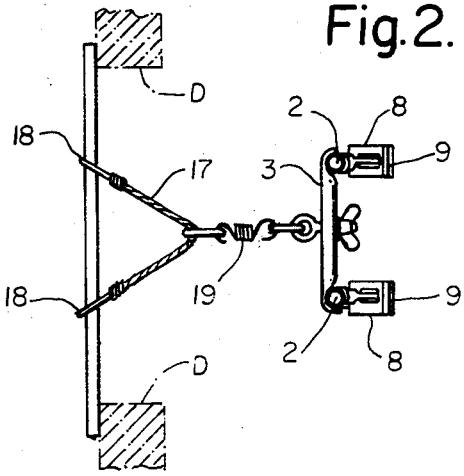
FIG. 4 is a cross-sectional view taken along line IV—IV of FIG. 2.

Referring more particularly to FIGS. 1 and 2 of the drawing, numeral 1 denotes a ladder-like weight frame having sides in the form of hollow telescoping rails 2, preferably of light metal such as aluminum. A plurality of vertically spaced cross bars 3 extend across the weight frame and are detachably fastened thereto such as by clamps secured by thumb nuts or the like. Each cross frame 3 supports, by means of an eye, a pulley 4.

Attached to the top portion of the weight frame 1 and, that is, on the rails 2 are a pair of elbows 5 having caps 6 of rubber or plastic material serving as stop elements. Caps 6 are also provided at the tops of rails 2.

Guy ropes 17 are provided for securely holding the weight frame against sliding movement on a floor or the like. The guy ropes 17 have hooks 18 at the ends which are fastened to a rod 16 which extends beyond the sides of a doorway opening D, shown in dot and dash outline. At the same time, the caps 6 at the top of the rail 2, rest against a doorframe, as shown in FIG. 2. Instead, hooks 18 may engage parts 7 and spring 19 hooked to the center of rod 16 which rod may be telescoped.

The rails 2 are adjustable in height by providing a plurality of holes 7a which may be moved into registry with corresponding holes spaced apart by the same distance in telescoping tube base parts 7. Floor pads 8 are provided at the bottom of the weight frame with stop flanges 9 extending therefrom.

A weight sled or carriage 10 is provided, which may be mounted on wheels 11. In some cases, the wheels may be omitted and the sled is merely slid along rails 2.

An internally threaded base support 12 is fastened to the bottom of the weight sled for supporting a pin 13 which is externally threaded at one end and screwed into the threads of part 12 to act as a support for selective numbers of weights W, each having a central hole therein.

A line or rope 14 of any suitable, strong flexible material may be fastened, at one end, to an eye 15 attached to the weight frame and may be entrained, selectively, either about the top pulley 4, as shown in dot and dash outline, or about a central pulley 4, as shown in full lines, or about the lowermost pulley 4, as shown in dot and dash outline, depending upon the type of sports item that is being swung during the exercise. As an example, a bat 17, having an eye **14*a* rigidly secured thereto, is detachably connected to the extremity of the line 14 as shown. As the bat is swung forwardly, it is resisted by the weight of the weight sled. Other substitute sports items can be used instead of bat 17** such as a tennis raquet or a short handled device. A hockey stick or bowling ball or ankle harness will probably be attached to the lowermost pulley.

The weight frame may be propped against a doorway opening or against a basement floor joist or the top of a garage door opening with the various components in place.

The line position is dictated by the particular sports item handle to be used. If more strength is desired for throwing a foorball, the uppermost position of the line would be used. If more power is desired by hockey players or bowlers, then the hockey handle or bowling ball used would be in the lowermost line position.

The weight frame, if desired, may be made in two parts, telescoped together at a central intermediate position, if desired, to make it more readily foldable into a compact unit, or it may be pivoted centrally so as to be collapsible to one half of normal height (not shown).

Thus it will be seen that I have provided a highly efficient exercising device that enables the development of muscles and skills in numerous sports items by the mere selection of the elevation at which the line will be pulled in a forward direction, thereby providing great versatility to the device; also I have provided an exercising device which is extremely light in weight, inexpensive to manufacture, being made of a minimum number of simple standard parts, and, most of all, which requires no anchoring by permanent fastening means to a wall or floor but, instead, simply props against a doorway so that the device may be easily and quickly mounted, dismounted and stored away in a cupboard or the like.

While I have illustrated and described a single specific embodiment of my invention, it will be understood that this is by way of illustration only and that various changes and modifications may be contemplated in my invention and within the scope of the following claims.

I claim:

1. A portable exercising device comprising a rectangular frame, which has side frame members, and which is adapted to be leaned and inclined against a door frame and being of greater length than the height of said frame, said rectangular frame being devoid of attaching means either to a wall or floor of a building, said rectangular frame having a weight carrying carriage mounted thereon which is guided along the frame by the inclined side frame members, a line attached at one end to said carriage, a pulley secured at the top portion of said rectangular frame about which said line is entrained, pulley means connected to the intermediate portion of said rectangular frame to enable the intermediate portion of said line to extend at selective heights through the opening of said door frame and substantially at right angles to said rectangular frame, the other end of the line being detachably secured to a sports item held by a user which may be swung forwardly under resistance of the weight of said carriage, whereby a pulling force is applied to said rectangular frame in the direction of said door frame.

2. A portable sxercising device as recited in claim 1 together with a stop element secured to the top portion of said rectangular frame and engageable with the head portion of said door frame to limit vertically upward movement of said rectangular frame.

3. An exercising device as recited in claim 1 wherein said sides of the rectangular frame comprise telescoping adjustable rails for selectively increasing or decreasing the length of said rectangular frame.

4. An exercising device as recited in claim 1 together with a guy rope detachably connected to a central, bottom portion of said rectangular frame, and a rod detachably connected to the extremities of said guy rope, which rod extends beyond the width of a door opening so as to securely hold the bottom of said rectangular frame against sliding away from the bottom of a door opening.

5. An exercising device as recited in claim 4 together with a spring connected intermediate said guy rope.

6. An exercising device as recited in claim 1 wherein said carriage has wheels adapted to ride along said sides of said rectangular frame.

* * * * *